US006479933B1

(12) United States Patent
Chen

(10) Patent No.: US 6,479,933 B1
(45) Date of Patent: Nov. 12, 2002

(54) FULL-COLOR PLASMA DISPLAY PANEL THAT USES DIFFERENT DISCHARGE GASES TO EMIT DIFFERENT COLORED LIGHT

(75) Inventor: Po-Cheng Chen, Yung-Ho (TW)

(73) Assignee: Acer Display Technology, Inc., Hsinchu (TW)

( * ) Notice: Subject to any disclaimer, the term of this patent is extended or adjusted under 35 U.S.C. 154(b) by 0 days.

(21) Appl. No.: 09/576,139

(22) Filed: May 22, 2000

(30) Foreign Application Priority Data

Mar. 10, 2000 (TW) ..... 089104332 A

(51) Int. Cl.[7] ..... H01J 17/02
(52) U.S. Cl. ..... 313/582; 445/25; 445/38
(58) Field of Search ..... 313/582, 586, 313/587, 581; 445/25, 24, 38, 42, 44, 53, 56; 315/169.4; 345/37, 41, 60

(56) References Cited

U.S. PATENT DOCUMENTS 5,525,862 A * 6/1996 Miyazaki ..... 313/582
5,742,122 A * 4/1998 Ammiya et al. ..... 313/587 X
5,825,128 A * 10/1998 Betsui et al. ..... 313/582

* cited by examiner

*Primary Examiner*—Ashok Patel
(74) *Attorney, Agent, or Firm*—Winston Hsu

(57) ABSTRACT

A PDP has a front and back substrates with a space between them. Barrier ribs in the space define discharge space groups. Each group has first, second and third discharge spaces. Each discharge space has an upper and a lower opening. Air-locking ribs seal the lower opening of the first discharge space, the upper opening and lower openings of the second discharge space, and the upper opening of the third discharge space. A first wall and the adjacent air-locking ribs defines a first channel which is accessible through each of the upper openings of the first discharge spaces. A second wall and the adjacent air-locking ribs defines a second channel which is accessible through each of the lower openings of the third discharge spaces. First, second and third gases respectively fill the first, second and third discharge spaces to emit different colored light.

6 Claims, 6 Drawing Sheets

FULL-COLOR PLASMA DISPLAY PANEL THAT USES DIFFERENT DISCHARGE GASES TO EMIT DIFFERENT COLORED LIGHT

BACKGROUND OF THE INVENTION

1. Field of the Invention

The present invention relates to a full-color plasma display panel, and more particularly, to a full-color plasma display panel that uses different discharge gases to emit different colored light.

2. Description of the Prior Art

Full-color plasma display panels (PDP) that use discharge gases to emit multi-colored light are a well-known type of planar display in the field. The luminous performance of the PDP is similar to that of millions of flat-shaped, minute fluorescent lights of various colors. The known PDP comprises phosphor materials that coat tiny discharge cells. The dimensions of these cells can be on the order of a few hundreds of microns. The cells are filled with a discharge gas made from neon (Ne) and xenon (Xe), or helium (He) and xenon (Xe). When excited, the discharge gas emits ultraviolet radiation. This irradiates the phosphor materials, which then emit red light, green light or blue light.

Please refer to FIG. 1. FIG. 1 is a perspective view of a full-color PDP 10 according to the prior art. The prior art full-color PDP 10 comprises a first substrate 12, a second substrate 14 parallel to the first substrate 12, a discharge gas (not shown) that fills the space between the first substrate 12 and the second substrate 14, a plurality of first electrodes 18, a plurality of second electrodes 20, and a plurality of third electrodes 22. The first electrodes 18 and the second electrodes 20 are positioned on the first substrate 12 in parallel and at regular intervals. Each of the third electrodes 22 are positioned on the second substrate 14 and are orthogonal to the first electrodes 18 and the second electrodes 20. Each of the first electrodes 18 and the second electrodes 20 comprises a maintaining electrode 181, 201, respectively, made of ITO materials, and an auxiliary electrode 182, 202, respectively, made of a Cr/Cu/Cr metal alloy. The maintaining electrode 181, 201 has high resistance and poor conductivity, but is transparent to visible light. The auxiliary electrode 182, 202 has a low resistance, and so increases the conductivity of its respective electrode 18, 20.

The full-color PDP 10 further comprises a dielectric layer 24 that covers the surfaces of the first substrate 12, the first electrodes 18 and the second electrodes 20. A protective layer 26 covers the dielectric layer 24. A plurality of barrier ribs 28 are positioned in parallel on the second substrate 14, and isolate adjacent third electrodes 22 to define a plurality of discharge spaces 30. A phosphor layer 32 coats the third electrode 22 and the barrier rib 28 within each discharge space 30. The phosphor layer 32 under radiation may emit either red light, green light or blue light. Each of the discharge spaces 30 is part of a plurality of unit display elements 34, which are a specific region defined by one of the first electrodes 18, one of the second electrodes 20, and one of the third electrodes 22. When an initiating voltage is induced between the first electrode 18 and the third electrode 22, an electric field results in ionization of the discharge gas between the first electrode 18 and the third electrode 22 and charges form on the walls. The first electrode 18 and the second electrode 20 drive the plasma formed in the unit display element 34 in an alternating fashion, causing it to continuously emit ultraviolet radiation. Under this ultraviolet radiation, the phosphor layer 32 emits light of a predetermined color, and this light is passed on to a user through the transparent first substrate 12.

The color of the light emitted from the phosphor layer 32 depends upon the phosphor materials used. When ((Y,Gd)$BO_3$) is applied to the phosphor, and Eu is added as an activating agent, the phosphor layer 32 will emit red light. When $Zn_2SO_4$is applied to the phosphor, and Mn is added as an activating agent, the phosphor layer 32 will emit green light. When $BaMgAl_{14}O_{23}$ is applied to the phosphor, and Eu is added as an activating agent, the phosphor layer 32 will emit blue light. However, the fabrication process of the phosphor materials is complicated, and the price of these materials is not cheap. Additionally, the red light emitted from the phosphor layer 32 lacks color purity. The green light emitted from the phosphor layer 32 is too persistent. The blue light emitted from the phosphor layer 32 suffers from color degradation over time. Finally, the phosphor layer 32 coated within the discharge space 30 is easily damaged by plasma bombardment, which shortens the usable life of the full-color PDP 10.

SUMMARY OF THE INVENTION

It is an object of the present invention to provide a full-color PDP that uses different discharge gases to emit specifically colored light, and which doesn't use phosphor materials, so as to avoid the above-mentioned problems.

In accordance with the claimed invention, the present invention PDP comprises a back substrate, and a front substrate positioned on the back substrate. A space is formed between the facing surfaces of the back substrate and the front substrate. A plurality of barrier ribs is positioned within the space for defining a plurality of discharge space groups. Each group comprises a first discharge space, a second discharge space, and a third discharge space, wherein each discharge space comprises an upper opening on an upper side of the discharge space and a lower opening on a lower side of the discharge space. Furthermore, a plurality of air-locking ribs are positioned within the space to seal the lower opening of the first discharge space, the upper opening and lower opening of the second discharge space, and the upper opening of the third discharge space. A first wall is positioned on an upper side of the plurality of the discharge space groups, wherein the first wall and the adjacent air-locking ribs define a first channel which is accessible through each of the upper openings of the first discharge spaces. A second wall is positioned on a lower side of the plurality of the discharge space groups, wherein the second wall and the adjacent air-locking ribs define a second channel which is accessible through each of the lower openings of the third discharge spaces. In addition, a first gas, a second gas, and a third gas respectively fill the first discharge space, the second discharge space, and the third discharge space to emit different colored light.

It is an advantage of the present invention that the PDP, without phosphor materials, uses different discharge gases as light sources, so the problems associated with phosphor materials are avoided, and the useable lifetime of the PDP is increased.

These and other objectives of the present invention will no doubt become obvious to those of ordinary skill in the art after having read the following detailed description of the preferred embodiment which is illustrated in the various figures and drawings.

DETAILED DESCRIPTION OF THE PREFERRED EMBODIMENT

Figure 1:
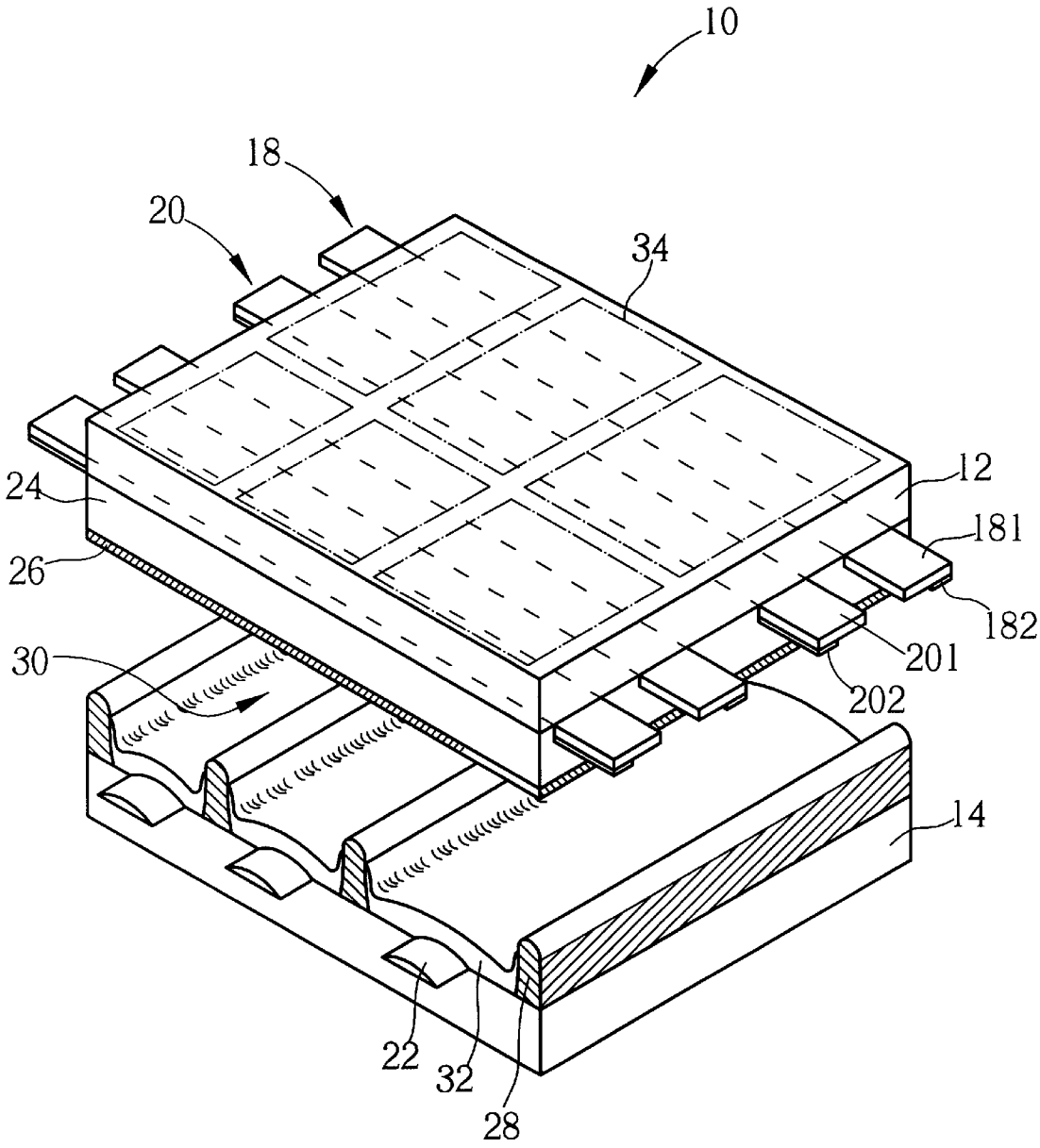
Fig. 1 Prior art
FIG. 1 is a perspective view of a full-color PDP according to the prior art.
Figure 2:
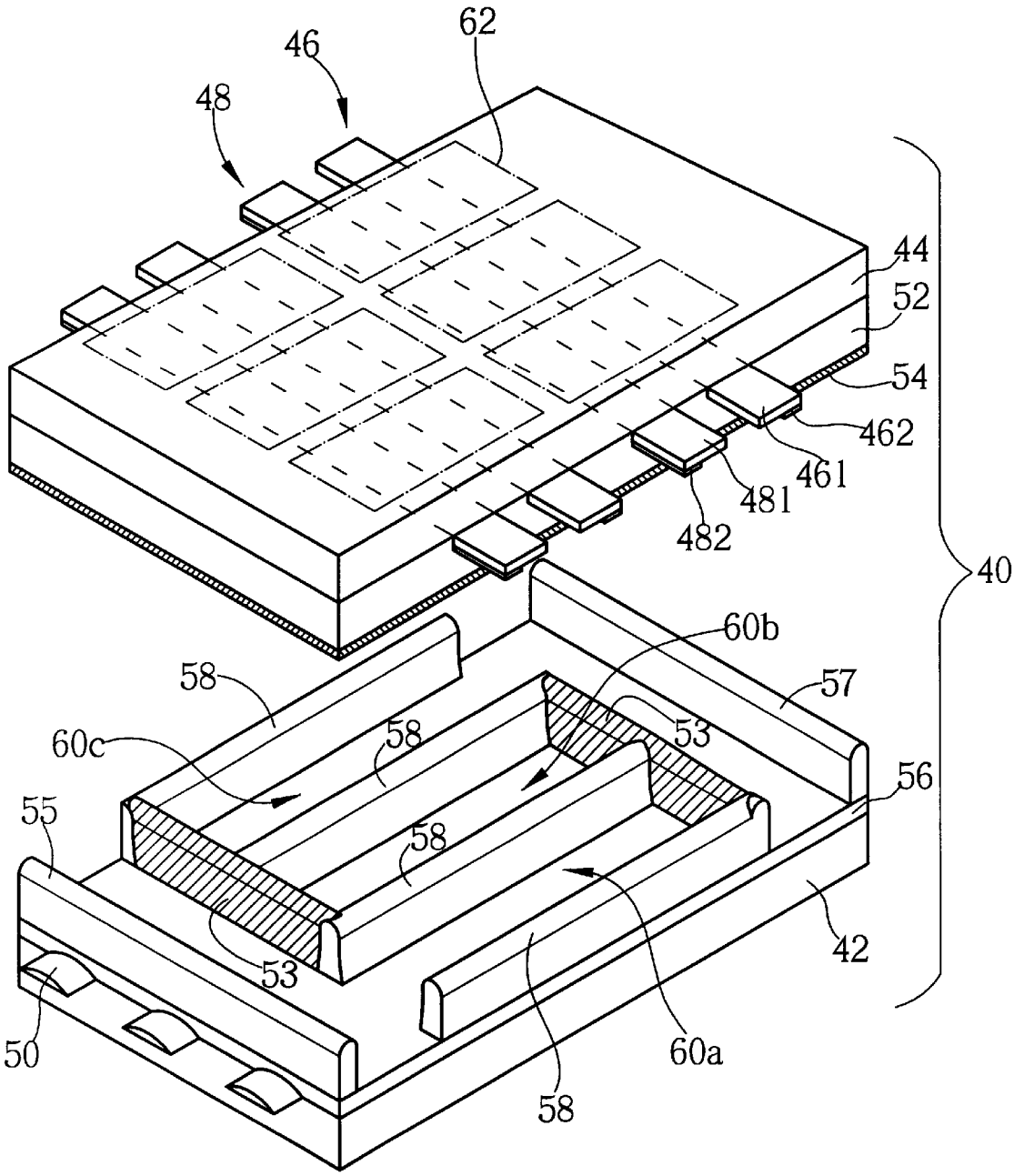
FIG. 2 is a perspective view of a full-color PDP according to the present invention.

Please refer to FIG. 2. FIG. 2 is a perspective view of a full-color PDP 40 according to the present invention. The full-color PDP 40 of the present invention comprises a back substrate 42, and a front substrate 44 positioned parallel to and spaced apart from the back substrate 42 to make the plasma space formed between the front substrate 44 and the back substrate 42. A plurality of first electrodes 46, second electrodes 48, and third electrodes 50 are formed between the front substrate 44, and the back substrate 42. The first electrodes 46 and the second electrodes 48 are positioned in parallel on the front substrate 44. The third electrodes 50 are called address electrodes, and are positioned on the back substrate 42, orthogonal to the first electrodes 46 and the second electrodes 48. Each of the first electrodes 46 and the second electrodes 48 comprises a maintaining electrode 461, 481, respectively, and a auxiliary electrode 462, 482, respectively, that is narrower in width than the maintaining electrode 461, 481. The maintaining electrodes 461, 481 are transparent and are made of indium tin oxide (ITO), or tin oxide (SnO). The auxiliary electrodes 462, 482 are made of a Cr/Cu/Cr metal alloy or Ag, and have good conductivity characteristics so as to increase the conductivity of the first electrode 46 and the second electrode 48.

The full-color PDP 40 further comprises a dielectric layer 52 that covers the surfaces of the front substrate 44, the first electrodes 46 and the second electrodes 48. A second protective layer 56 covers the surfaces of the back substrate 42 and the third electrodes 50. The PDP 40 also comprises a plurality of barrier ribs 58 positioned in parallel on the back substrate 42 for defining a plurality of discharge space groups, a plurality of air-lock ribs 53, a first wall 55 and a second wall 57. Each discharge space group comprises a first discharge space 60*a*, a second discharge space 60*b*, and a third discharge space 60*c*. Each discharge space 60*a*~60*c* comprises a plurality of unit display elements 62, and each unit display element 62 is defined as an intersection defined by one of the first electrodes 46, one of the second electrodes 48, and one of the third electrodes 50. Hence, all of the unit display elements 62 are arranged as a matrix within the discharge spaces 60*a*~60*c*.

The full-color PDP 40, without the use of phosphor materials, uses only discharge gases as a medium for luminescence. The discharge gases comprise a first discharge gas (not shown) that fills the first discharge spaces 60*a*, a second discharge gas (not shown) that fills the second discharge spaces 60*b*, and a third discharge gas (not shown) that fills the third discharge spaces 60*c*. These gasses are used to emit the primary colors of red, green and blue light. A mixture of neon (Ne) and argon (Ar) is used to emit red light. A mixture of xenon (Xe) and oxygen ($O_2$) is used to emit green light. A mixture of krypton (Kr) and neon (Ne) is used to emit blue light. When an initiating voltage is induced between the first electrode 46 and the third electrode 50, an electric field between the first electrode 46 and the third electrode 50 ionizes the discharge gas, forming wall charges. The first electrode 46 and the second electrode 48 then alternately drive the plasma formed in the unit display element 62, causing it to continuously emit visible light. This light passes through the transparent front substrate 44 to the user.

Figure 3:
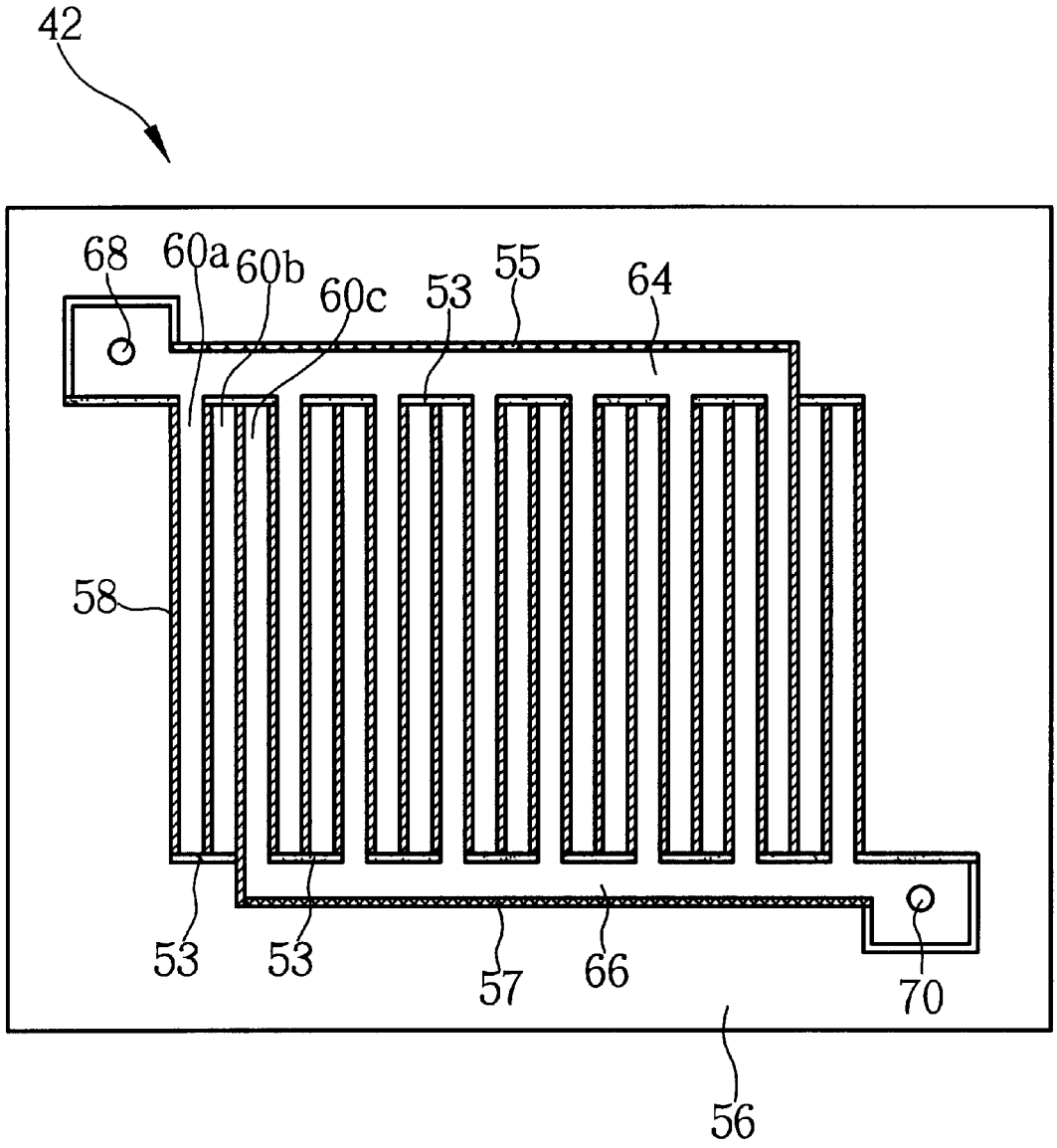
FIG. 3 is a top view of barrier ribs and discharge spaces shown in FIG. 2.

Please refer to FIG. 3. FIG. 3 is a top view of the barrier ribs 58 and discharge spaces 60 shown in FIG. 2. A plurality of upper openings are formed on an upper side of the first discharge spaces 60*a*, the second discharge spaces 60*b*, and the third discharge spaces 60*c*. A plurality of lower openings are formed on a lower side of the first discharge spaces 60*a*, the second discharge spaces 60*b*, and the third discharge spaces 60*c*. Along both the upper side and lower side of the plurality of discharge space groups, the air-locking ribs 53 positioned on the back substrate 42 are perpendicular to the barrier ribs 58 and seal the lower opening of the first discharge space 60*a*, the upper and lower opening of the second discharge space 60*b*, and the upper opening of the third discharge space 60*c*. The first wall 55 is positioned on the upper side of the plurality of the discharge space groups. A first channel 64 is defined by the first wall 55, and the neighboring air-locking ribs 53, and the first channel 64 is accessible through each of the upper openings of the first discharge spaces 60*a*. The second wall 57 is positioned on the lower side of the plurality of the discharge space groups. A second channel 66 is defined by the second wall 57 and the neighboring air-locking ribs 53, and the second channel 66 is accessible through each of the lower openings of the third discharge spaces 60*c*. Therefore, the first channel 64 enables the first discharge gas to circulate among all of the first discharge spaces 60*a*, and the second channel 66 enables the third discharge gas to circulate among all of the third discharge spaces 60*c*. The second discharge gas is locked within each of the second discharge spaces 60*b*. The PDP 40 also comprises a first vent 68 communicated with the first channel 64, and a second vent 70 communicated with the second channel 66. Through the first vent 68, the original existing gas can be evacuated and the first discharge gas is then filled into the first channel 64. Through the second vent 70, the original existing gas can be evacuated and the third discharge gas is then filled into the second channel 66.

In other words, corresponding to the first discharge spaces 60*a*, the second discharge spaces 60*b*, and the third discharge spaces 60*c* respectively, we can define the upper opening as the first, third, and fifth opening, and also define the lower opening as the second opening, forth opening, and the sixth opening. The plasma display panel 40 according to the present invention comprises the back substrate 42 and the front substrate 44. The front substrate 44 is positioned parallel to and spaced apart from the back substrate 42 and defines the plasma space between the back substrate 42 and the front substrate 44. The first wall 55 is horizontally positioned along the upper side of the plasma space, and the second wall 57 is horizontally positioned along the lower side of the plasma space. A plurality of barrier ribs 58 are vertically positioned within the plasma space for defining the discharge space groups, and each of the discharge space groups has the first discharge space 60*a*, the second discharge space 60*b*, and the third discharge space 60*c*. Each of the first discharge spaces 60*a* has the first opening formed near the first wall 55 and the second opening formed near the second wall 57. Each of the second discharge spaces 60*b* has the third opening formed near the first wall 55 and the fourth opening formed near the second wall 57. Each of the third discharge spaces 60*c* has the fifth opening formed near the first wall 55 and the sixth opening formed near the second wall 57. The upper portion of the air-locking rib 53 is formed between the first wall 55 and the discharge space group to seal the third opening of each second discharge space 60*b* and the fifth opening of each third discharge space 60*c*. The first wall 55 and the neighboring air-locking rib 53 define the first channel 64 to communicate with the plurality of first discharge spaces 60*a* through the upper openings. The lower portion of the air-locking rib 53 is formed between the second wall 57 and the discharge space group to seal the second opening of each first discharge space 60*a* and the fourth opening of each second discharge space 60*b*. The second wall 57 and the neighboring air-locking rib 53 define the second channel 66 to communicate with the plurality of third discharge spaces 60*c* through the sixth openings. The first discharge gas, the second discharge gas, and the third discharge gas for emitting different colored light are respectively filled within the first discharge spaces 60*a*, the second discharge spaces 60*b*, and the third discharge spaces 60*c*.

Please refer to FIG. 4 to FIG. 8. FIG. 4 to FIG. 8 are schematic diagrams of a method of forming the full-color PDP 40 shown in FIG. 2. The method of forming the full-color PDP 40 comprises forming the front substrate 44, forming the barrier ribs 58 on the back substrate 42, sealing the completed back substrate 42 and front substrate 44, and filling the discharge spaces with their appropriate discharge gases.

Figure 4:
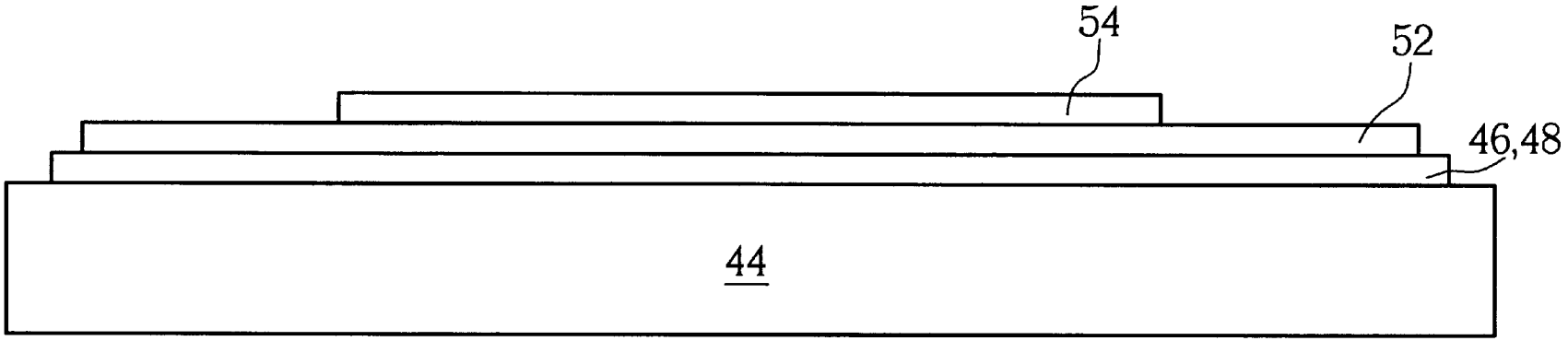
FIGS. 4 to 8 are schematic diagrams of a method of forming the full-color PDP shown in the FIG. 2.

Referring to FIG. 4, a plurality of first electrodes 46 and second electrodes 48 are formed in parallel on the front substrate 44. A dielectric layer 52, made of glass slurry, covers the surfaces of the front substrate 44, the first electrodes 46 and the second electrodes 48. A first protective layer 54, made of MgO, covers the dielectric layer 52.

Figure 5:
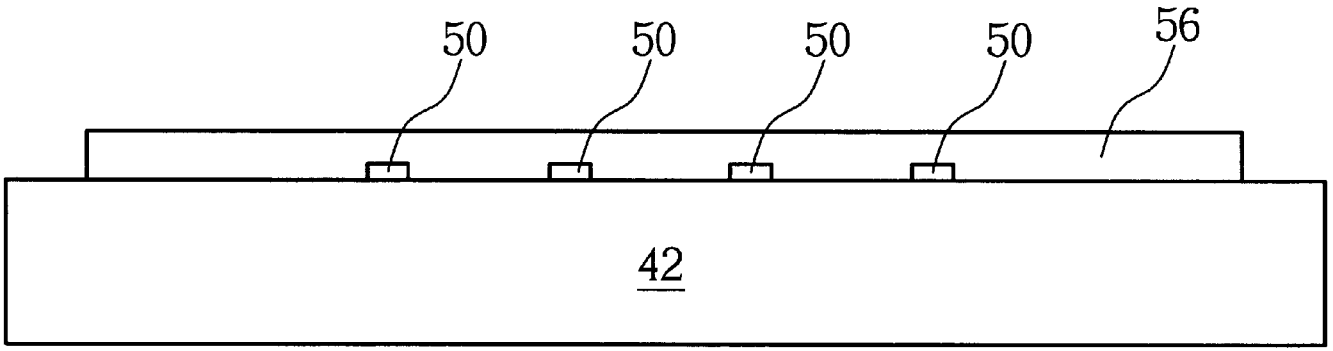

As shown in FIG. 5, a plurality of third electrodes 50 are installed in parallel on the back substrate 42, and a second protective layer 56 is used to cover the back substrate 42 and the third electrodes 50. The second protective layer 56 prevents damage to the third electrodes 50 from subsequent processes.

Figure 6:
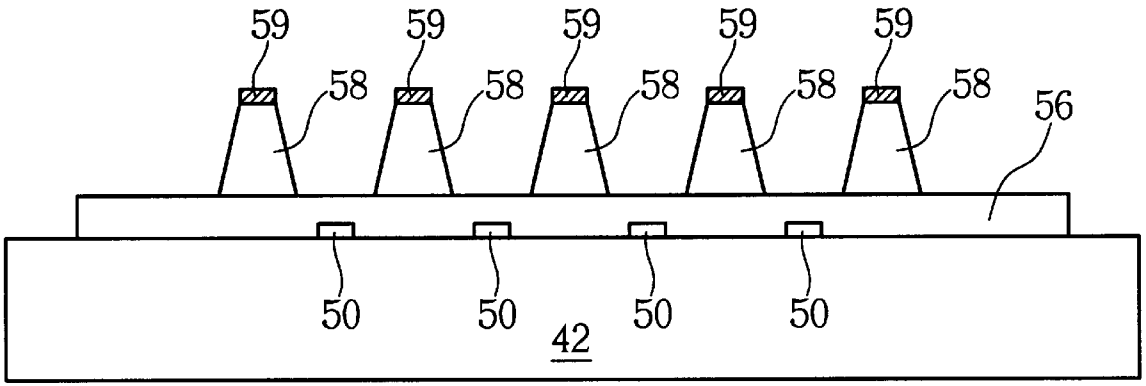
Figure 7:
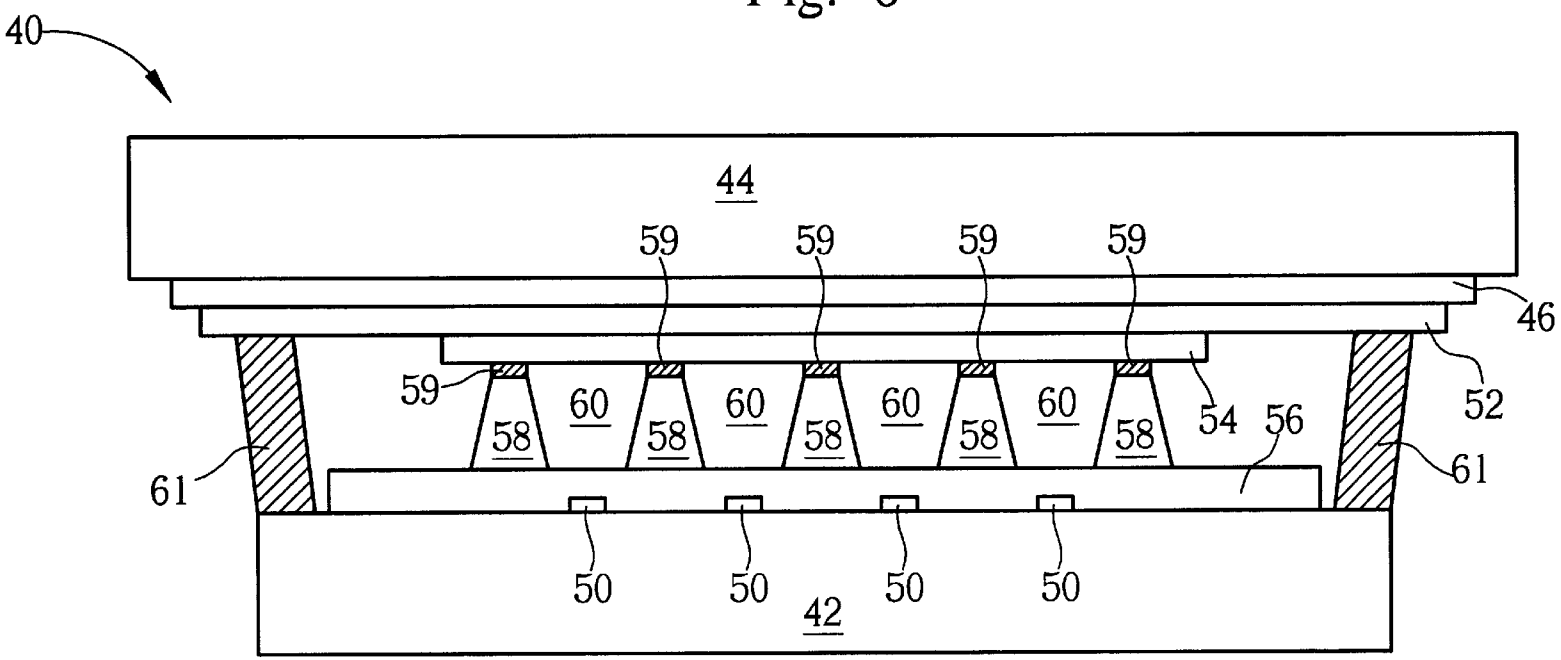

As shown in FIG. 6, according to the design of the barrier ribs 58 shown in FIG. 3, the plurality of barrier ribs 58, air-locking ribs 53, the first wall 55 and the second wall 57 are formed on the back substrate 42. Generally, the method of forming the barrier ribs could involve any of many methods, such as net-printing, sandblasting, imbedding, etc. Sandblasting yields the highest quality barrier ribs 58, and comprises coating barrier rib materials onto the second protective layer 56, coating photoresist materials onto the barrier rib materials, a photolithographic process to define the pattern of the barrier ribs 58 into the photoresist, a sandblasting process that uses the patterned photoresist as a hard mask to etch away unwanted barrier rib materials, removing the remaining photoresist materials, and sintering. After the ribs and walls are completed, a sealing material 59 is coated onto each top surface of the barrier ribs 58. As shown in FIG. 7, another sealing material 61 is coated at the periphery of the back substrate 42 for sealing the front substrate 44 onto the back substrate 42 so as to substantially complete the PDP 40.

Figure 8:
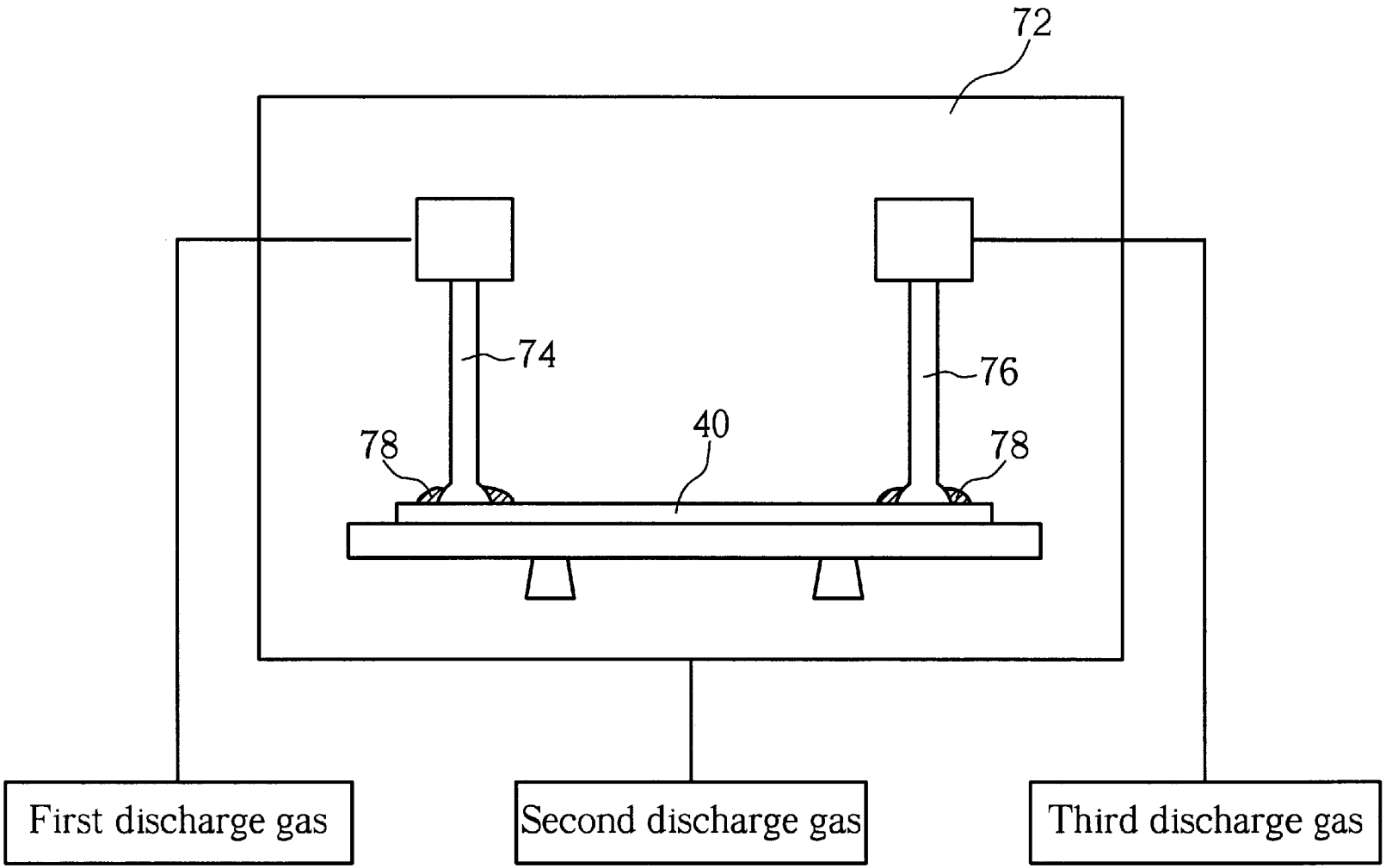

As shown in FIG. 8, the PDP 40 is loaded in an enclosed chamber 72 to fill each of the discharge spaces 60 with the appropriate discharge gases. First, the atmosphere originally filled within the chamber 72 is extracted, and the second discharge gas is injected to fill this chamber 72. Then, the temperature of the chamber 72 is increased to above the softening point temperature (Ts) of the sealing materials 59, 61 first; and then the temperature of the chamber 72 is lowered to a specific temperature that is lower than the softening point temperature (Ts) of the sealing materials 59, 61. This above sealing process causes the front substrate 44 and the back substrate 42 bonded together by the sealing materials 59, 61, locking the second discharge gas within each discharge spaces 60*a*~60*c*, the first channel 64, and the second channel 66. Next, the remaining discharge gases are loaded into their appropriate discharge spaces. To do this, two tubes 74, 76 are respectively connected to the first vent 68 and the second vent 70 by using another sealing material 78. Through the tube 74 positioned on the first vent 68, the second discharge gas originally filled within the first channel 64 and the first discharge spaces 60*a* is extracted. The first discharge gas is then loaded into the first channel 64 and the first discharge spaces 60*a*. In the same manner, the third discharge gas originally filled within the second channel 66 and the third discharge spaces 60*c* is extracted through the tube 76 positioned on the second vent 70. The third discharge gas is then loaded into the second channel 66 and the third discharge spaces 60*c*. Finally, a heating process is applied to tip off the tubes 74, 76 to prevent the discharge gases leaking from the vents 68, 70. The finished PDP 40 is then removed from the chamber 72.

The completed PDP 40 comprises the first discharge gas that fills the first discharge spaces 60*a*, the second discharge gas that fills the second discharge spaces 60*b*, and the third discharge gas that fills the third discharge spaces 60*c*. After an initiating voltage is induced within the PDP 40, the first discharge gas, the second discharge gas and the third discharge gas will respectively emit red light, green light and blue light, which are shown to the user from the front substrate 44.

The full-color PDP 40, without the use of phosphor materials, uses different discharge gases as the medium for luminescence, and thus avoids the problems associated with phosphor materials. This increases the usable lifetime of the full-color PDP 40. Furthermore, using different discharge gases to emit different colored light increases both the luminance and luminous efficiency of each unit display element 62. As the step for coating phosphor materials into the discharge spaces is not required, the method of forming the PDP 40 is simplified. The design of the barrier ribs 58 enables the first discharge gas, filled from the first vent 68, to circulate amongst all of the first discharge spaces 60*a*, and it also enables the third discharge gas, filled from the second vent 70, to circulate amongst all of the third discharge spaces 60*c*. Hence, it is not difficult to fill the first discharge spaces 60*a* and the third discharge spaces 60*c* with the first discharge gas and the third discharge gas.

Compared to the prior art PDP 10, the full-color PDP 40 of the present invention uses different discharge gases to emit different colored light. It comprises the first discharge gas filling the first discharge spaces 60*a*, the second discharge gas filling the second discharge spaces 60*b*, and the third discharge gas filling the third discharge spaces 60*c*. These gases are used to emit the primary colors of red, green and blue. The full-color PDP 40, without the use of phosphor materials, uses different discharge gases as the medium for luminescence, and thus avoids the problems associated with phosphor materials, as well as increasing the usable lifetime of the PDP 40.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A plasma display panel comprising:

a back substrate;

a front substrate positioned parallel to and spaced apart from the back substrate and forming a space between the back substrate and the front substrate;

a plurality of barrier ribs positioned within the space for defining a plurality of discharge space groups, each group comprising a first discharge space, a second discharge space, and a third discharge space, each discharge space comprising an upper opening on an upper side of the discharge space and a lower opening on a lower side of the discharge space;

a plurality of air-locking ribs positioned within the space to seal the lower opening of the first discharge space, the upper opening and lower opening of the second discharge space, and the upper opening of the third discharge space;

a first wall positioned on an upper side of the plurality of the discharge space groups, the first wall and the neighboring air-locking ribs defining a first channel which is accessible through each of the upper openings of the first discharge spaces;

a second wall positioned on a lower side of the plurality of the discharge space groups, the second wall and the neighboring air-locking ribs defining a second channel which is accessible through each of the lower openings of the third discharge spaces; and a first discharge gas, a second discharge gas, and a third discharge gas respectively filling the first discharge space, the second discharge space, and the third discharge space, each discharge gas being used to emit a specifically colored light.

2. The plasma display panel of claim 1 wherein each of the first discharge spaces is connected with the first channel to enable the first discharge gas to circulate amongst all of the first discharge spaces, each of the third discharge spaces is connected with the second channel to enable the third discharge gas to circulate amongst all of the third discharge spaces, and the second discharge gas is locked within each of the second discharge spaces.

3. The plasma display panel of claim 2 wherein the plasma display panel further comprises a vent positioned in the first channel to deliver the first discharge gas to the first channel, and another vent positioned in the second channel to deliver the third discharge gas to the second channel.

4. The plasma display panel of claim 1 wherein the discharge gases comprises a discharge gas made of neon (Ne) and argon (Ar) for emitting red light, a discharge gas made of xenon (Xe) and oxygen ($O_2$) for emitting green light, and a discharge gas made of krypton (Kr) and neon (Ne) for emitting blue light.

5. A method of forming a plasma display panel, the plasma display panel comprising a back substrate and a front substrate, the method comprising:

forming a plurality of barrier ribs on the back substrate for defining a plurality of discharge space groups, each group comprising a first discharge space, a second discharge space and a third discharge space, each discharge space comprising a upper opening on an upper side of the discharge space and a lower opening on a lower side of the discharge space;

forming a plurality of air-locking ribs on the back substrate to seal the lower opening of the first discharge space, the upper opening and lower opening of the second discharge space, and the upper opening of the third discharge space;

forming a first wall on the back substrate on an upper side of the plurality of the discharge space groups, the first wall and the adjacent air-locking ribs defining a first channel which is accessible through each of the upper openings of the first discharge spaces;

forming a second wall on the back substrate on a lower side of the plurality of the discharge space groups, the second wall and the adjacent air-locking ribs defining a second channel which is accessible through each of the lower openings of the third discharge spaces;

in an enclosed chamber, sealing the front substrate and the back substrate to form a space between the back substrate and the front substrate, the enclosed chamber filled with a second discharge gas so as to fill the first discharge space, the second discharge space, the third discharge space, the first channel, and the second channel with the second discharge gas;

extracting the second discharge gas from the first channel and from the first discharge space through the first channel, and filling the first channel and the first discharge space with a first discharge gas; and extracting the second discharge gas from the second channel and from the third discharge space through the second channel, and filling the second channel and the third discharge space with a third discharge gas.

6. A plasma display panel comprising:

a back substrate;

a front substrate positioned parallel to and spaced apart from the back substrate and defining a plasma space between the back substrate and the front substrate;

a first wall positioned along an upper side of the plasma space;

a second wall positioned along a lower side of the plasma space;

a plurality of barrier ribs positioned within the plasma space for defining a discharge space group, the discharge space group comprising a first discharge space, a second discharge space, and a third discharge space, the first discharge space having a first opening formed near the first wall and a second opening formed near the second wall, the second discharge space having a third opening formed near the first wall and a fourth opening formed near the second wall, the third discharge space having a fifth opening formed near the first wall and a sixth opening formed near the second wall;

a first air-locking rib positioned between the first wall and the discharge space group to seal the third opening of the second discharge space and the fifth opening of the third discharge space, the first wall and the first air-locking rib defining a first channel to communicate with the first discharge space through the first opening;

a second air-locking rib positioned between the second wall and the discharge space group to seal the second opening of the first discharge space and fourth opening of the second discharge space, the second wall and the second air-locking rib defining a second channel to communicate with the third discharge space through the sixth opening; and a first discharge gas, a second discharge gas, and a third discharge gas for emitting different colored light being respectively filled into the first discharge space, the second discharge space, and the third discharge space.

* * * * *